US009589754B2

(12) United States Patent
Couzon et al.

(10) Patent No.: US 9,589,754 B2
(45) Date of Patent: Mar. 7, 2017

(54) ELECTRIC CONTACTOR AND CONTROL METHOD OF ONE SUCH CONTACTOR

(71) Applicant: Schneider Electric Industries SAS, Rueil-Malmaison (FR)

(72) Inventors: David Couzon, Froges (FR); Joel Reboulet, Varces (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 321 days.

(21) Appl. No.: 14/309,023

(22) Filed: Jun. 19, 2014

(65) Prior Publication Data

US 2014/0376144 A1 Dec. 25, 2014

(30) Foreign Application Priority Data

Jun. 25, 2013 (FR) ..... 13 56076

(51) Int. Cl.

| | |
|---|---|
| ***H01H 1/24*** | (2006.01) |
| ***H01H 50/54*** | (2006.01) |
| ***H01H 1/20*** | (2006.01) |
| ***H01H 9/40*** | (2006.01) |
| ***H01H 33/59*** | (2006.01) |
| ***H01H 50/02*** | (2006.01) |

(52) U.S. Cl.

CPC ..... *H01H 50/546* (2013.01); *H01H 1/20* (2013.01); *H01H 9/40* (2013.01); *H01H 33/596* (2013.01); *H01H 50/02* (2013.01)

(58) Field of Classification Search

CPC ..... H01H 50/546
USPC ..... 307/112
See application file for complete search history.

(56) References Cited

U.S. PATENT DOCUMENTS 4,536,814 A 8/1985 Theisen et al.
4,746,885 A * 5/1988 Ogata ..... H01H 50/323 218/113

(Continued)

FOREIGN PATENT DOCUMENTS

WO WO 2011/147458 A1 12/2011

OTHER PUBLICATIONS

French Preliminary Search Report issued Feb. 25, 2014 in FR Application 13 56076, filed on Jun. 25, 2013 ( with English Translation of Categories of Cited Documents and Written Opinion).

*Primary Examiner* — Stephen W Jackson
(74) *Attorney, Agent, or Firm* — Oblon, McClelland, Maier & Neustadt, L.L.P.

(57) ABSTRACT

The electrical contactor (100) according to the invention comprises at least one first switch (104) that includes a first moving contact (112) and several second switches (106) that include a second moving contact (116). The contactor further comprises at least one control device for controlling the movement of the or each first (112), second (116) moving contact, respectively. The control device is capable of controlling the movement of the or each first moving contact (112) into the open position before that of each second moving contact (116) into the open position, and when the or each first moving contact (112) is in the closed position, the second switches (106) are connected in parallel, whereas when the or each first moving contact (112) is in the open position, the second switches (106) are connected in series.

8 Claims, 6 Drawing Sheets

(56) References Cited

U.S. PATENT DOCUMENTS

| | | | | |
|---|---|---|---|---|
| 7,242,196 | B2 * | 7/2007 | Yudahira | B60L 3/0023 324/418 |
| 8,164,013 | B2 * | 4/2012 | Larcher | H01H 50/14 200/243 |
| 2013/0075367 | A1 | 3/2013 | Eriksson et al. | |

* cited by examiner

ELECTRIC CONTACTOR AND CONTROL METHOD OF ONE SUCH CONTACTOR

The present invention relates to an electrical contactor, as well as a method for controlling such a contactor.

An electrical contactor comprises at least one pair of fixed contacts, and for each pair of fixed contacts, a moving contact moving between a closed position and an open position. More specifically, the fixed contacts are electrically connected to each other when the moving contact is in the closed position, and electrically isolated from each other when the moving contact is in the open position.

One recurring issue in the field of electrical contactors is making the contactor work optimally for a direct current application, i.e., proposing a contactor architecture whereof the operation is optimized when a direct current passes through it and it is in a transitional opening period. The transitional opening period corresponds to a period where at least one moving contact is moving between the open position and the closed position.

In the field of electrical contactors, it is known to use the studied contactors for alternating current uses and to connect them to each other in series, in order to multiply the contacts. This multiplication of contacts makes it possible to optimize the direct current operation, and more particularly the opening of the moving contacts when an electric arc appears. In fact, the multiplication of the contacts makes it possible to split the electric arc that appears. However, in this type of contactor, the fixed and moving contacts of all of the electrical contactors connected in series must be sized so that their heating at the operating rated current is below the normative values.

During the operation of the electrical contactor, when the moving contacts are in the closed position, the powers dissipated by each contact are added to each other. Thus, the power dissipated in all of the contactors connected in series is considerable, and the thermal performance of the contactor, comprising all of its contactors connected in series, is not optimized.

It is also known from document WO 2011/147458 A1 to cable contactors designed to operate in alternating current in series, as previously explained. In order to improve the direct current performance of the contactor, it is proposed to insert a magnetic element which, during opening of the moving contacts, orients the created electric arc toward cutoff chambers and fragments it. However, this type of contactor does not always have an optimized thermal performance.

The aim of the invention is therefore to propose an electrical contactor which, when passed through by a direct current, during the transitional opening period, has a better thermal performance and improves the opening of its moving contacts.

To that end, the invention relates to an electrical contactor comprising:

- at least one first switch, the or each first switch including a pair of first fixed contacts and a first moving contact moving between a closed position and an open position,
- several second switches, each second switch including a pair of second fixed contacts and a second moving contact moving between a closed position and an open position,
- the first, second fixed contacts, respectively, being, in the closed position of the first, second moving contact, respectively, electrically connected to each other via the first, second moving contact, respectively, and being electrically isolated from each other in the open position of the first, second moving contact, respectively,
- at least one control device for controlling the movement of the or each first, second moving contact, respectively, in the open or closed position.

According to the invention, the contactor comprises, in the same housing, the first switch or switches and the second switches, while after the control device receives an order to open the contactor, the control device is capable of controlling the movement of the or each first moving contact into the open position before that of each second moving contact into the open position, with a time offset comprised between 10 milliseconds (ms) and 1 second (s) between the movement of the first moving contact(s) and the movement of the second moving contacts, preferably comprised between 50 ms and 500 ms, still more preferably comprised between 50 ms and 100 ms, and when the or each first moving contact is in the closed position, the second switches are connected in parallel, whereas when the or each first moving contact is in the open position, the second switches are connected in series.

According to advantageous aspects of the invention, the electrical contactor further comprises one or more of the following features, considered alone or according to all technically possible combinations:

- the contactor comprises a single contact-holder maintaining the first moving contact(s) and the second moving contacts, the control device being capable of controlling the movement of said contact-holder to open or close the first switch or switches and the second switches.
- the contact-holder is connected to the or each first moving contact and each second moving contact by at least one first spring and at least one second spring, respectively, while a first thrust force exerted by the or each first spring on the or each first moving contact is below a second thrust force exerted by the or each second spring on each second moving contact.

The invention also relates to a method for controlling an electrical contactor, comprising:

- at least one first switch, the or each first switch including a pair of first fixed contacts and a first moving contact moving between a closed position and an open position,
- several second switches, each second switch including a pair of second fixed contacts and a second moving contact moving between a closed position and an open position,
- the first, second fixed contacts, respectively, being, in the closed position of the first, second moving contact, respectively, electrically connected to each other via the first, second moving contact, respectively, and being electrically isolated from each other in the open position of the first, second moving contact, respectively,
- at least one control device for controlling the movement of the or each first, second moving contact, respectively, in the open or closed position.

According to the invention, the method comprises the following steps:

a) the reception by the control device of an order to open the contactor, b) the movement of the or each first moving contact into the open position, the second switches being connected in parallel when the or each first moving contact is in the closed position, and in series when the or each first moving contact is in the open position, c) the movement of each second moving contact into the open position after that of the or each first moving contact into the open position, with a time shift comprised between 10 milliseconds (ms) and 1 second (s), between the movement of the first moving contact(s) and the movement of the second moving contact(s), preferably comprised between 50 and 500 ms, still more preferably comprised between 50 ms and 100 ms.

Owing to the invention, the offset opening of the or each first moving contact relative to the second moving contact makes it possible, in the transitional opening period, i.e., just after receiving the opening order, to have an optimized thermal performance, and to ensure the opening of the first and second moving contacts.

The invention will be better understood, and other advantages thereof will appear, in light of the following description, provided solely as a non-limiting example, and done in reference to the appended drawings, in which.

Figure 1:
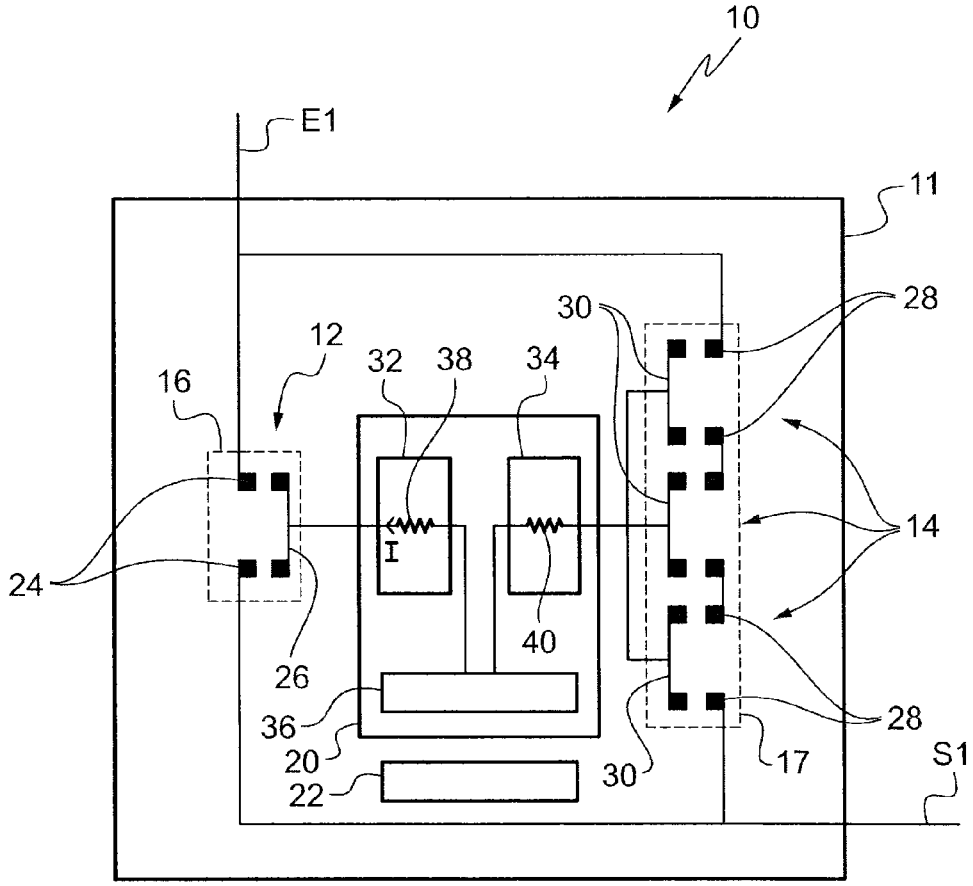
FIG. 1 is a diagrammatic illustration of an electrical contactor according to an aspect not belonging to the invention.

In FIG. 1, a contactor 10 according to one aspect not belonging to the invention is illustrated. The contactor 10 comprises a housing 11 that surrounds all of the elements comprised in the contactor 10.

The contactor 10 comprises a first switch 12 and three second switches 14. The first switch 12 is connected in parallel with the three second switches 14, and the three second switches 14 are connected in series.

The contactor 10 comprises a first contact-holder 16 associated with the first switch 12 and a second contact-holder 17 associated with the second switches 14.

The contactor 10 also comprises a control device 20 for controlling the contact-holders 16, 17 and a member 22 for supplying electricity to the control device 20.

The contactor 10 comprises a current input terminal E1 and a current output terminal S1. The input terminal E1 and the output terminal S1 are capable of being connected to an electrical facility, not shown, equipped with the contactor 10.

The first switch 12 comprises a pair of first fixed contacts 24 and a first moving contact 26 moving between a closed position and an open position. In the closed position of the first moving contact 26, the first fixed contacts 24 are electrically connected to each other via the first moving contact 26, and in the open position of the first moving contact 26, electrically isolated from each other. In FIG. 1, the first moving contact 26 is in the open position.

Each second switch 14 comprises a pair of second fixed contacts 28 and one second contact 30 movable between a closed position and an open position. In the closed position of each second moving contact 30, the second fixed contacts 28 are electrically connected to each other via each second moving contact 30, and are electrically isolated from each other in the open position of each second moving contact 30. In FIG. 1, each second moving contact 30 is in the open position.

The first contact-holder 16 is capable of maintaining each first moving contact 26. Each first moving contact 26 is for example securely fastened to the first contact-holder 16, such that the movement of the first contact-holder 16 automatically drives the movement of each first moving contact 26.

The second contact-holder 17 is capable of maintaining each second moving contact 30. Each second moving contact 30 is for example securely fastened to the second contact-holder 17, such that the movement of the second contact-holder 17 automatically drives the movement of each second moving contact 30.

The control device 20 comprises a first control member 32 for controlling the first contact-holder 16 and a second control member 34 for controlling the second contact-holder 17. The control device 20 also comprises a member 36 for synchronizing the first and second control members 32, 34.

The control device 20 is capable of controlling the movement of the first 16 and second 17 contact-holders to open or close the first moving contact 26 and the second moving contact 30, respectively, i.e., to open or close the first switch 12 and each second switch 14, respectively.

Each first moving contact 26 and each first fixed contact 24 are sized so that their rated working current heating, i.e., at the rated working current of the electrical facility, is below a normative value. For example, for a rated working current of 65 Amperes, the heating of each first moving contact 26 and each first fixed contact 24 is below 65° Celsius. Normatively, the temperature is measured across the terminals E1, S1, i.e., the current input and current output, respectively.

Each second moving contact 30 and each second fixed contact 28 are sized so as to have a minimal deterioration when an electric arc appears, during the opening of each second moving contact 30. In fact, the second switches 14 are intended, when their second moving contact 30 is open, to have an electric arc form between the second moving 30 and fixed 28 contacts, respectively.

The first control member 32 and the second control member 34 respectively comprise a first control coil 38 and a second control coil 40.

The synchronizing member 36 is capable, when the first moving contact 26 is opened, of measuring a current I passing through the first control coil 38. The synchronizing member 36 is capable of controlling the opening of the second moving contact 30, via the second control member 34, based on the value of the current I.

The first coil 38 and the second coil 40 are capable of controlling the movement of the first contact-holder 16 and the second contact-holder 17, respectively, to open or close the first moving contact 26 and the second moving contact 30, respectively.

In the closed position of the first moving contact 26 and of each second moving contact 30, the input terminal E1 and the output terminal S1 are electrically connected to each other, and the first switch 12 is connected in parallel with the second switches 14, which in turn are connected in series.

When the first moving switch 26 and each second moving switch 30 are in the closed position, and an order to open the contactor 10 is received by the control device 20, the control device 20 uses the first control member 32 and the second control member 34, and the first coil 38 and the second coil 40, to control the movement of the first moving contact 26 into the open position before controlling the movement of each second moving contact 30 into the open position. More specifically, the opening is done with a time offset between the first moving contact 26 on the one hand, and the second moving contact 30 on the other hand. The time offset between the movement of the first moving contact 26 into the open position and the movement of the second moving contact 30 into the open position is comprised between 50 milliseconds (ms) and 1 second, preferably comprised between 100 ms and 500 ms, still more preferably comprised between 100 ms and 200 ms.

After receiving the opening order, the synchronizing member 36 measures the current I circulating in the first coil 38, the first coil 38 for example including a moving magnetic core, not shown, which drives the movement of the first contact-holder 16. When that moving core moves, the first contact-holder 16 is moved in order to cause the first moving contact 26 to open, and the moving magnetic core consumes current. Thus, the current I that passes through the first coil 38 and is measured by the synchronizing unit 36 increases. Then, when the first moving contact 26 is in the open position, the moving core stops and no longer consumes any current. Thus, the current I passing through the coil 38 is stable, and the first contact-holder 16 has traveled its entire opening travel. Once the synchronizing unit 36 detects that the current passing through the first coil 20 is no longer increasing or has reached a predetermined value, it uses the second control member 34 and the second coil 40 to control the opening of each second moving contact 30, the second moving contacts 30 being moved into the open position quasi-simultaneously, given that they are all securely maintained by the second contact-holder 17.

Thus, the time offset in the opening of the first moving contact 26 and the second moving contacts 30 is done based on the value of the current I.

Figure 2:
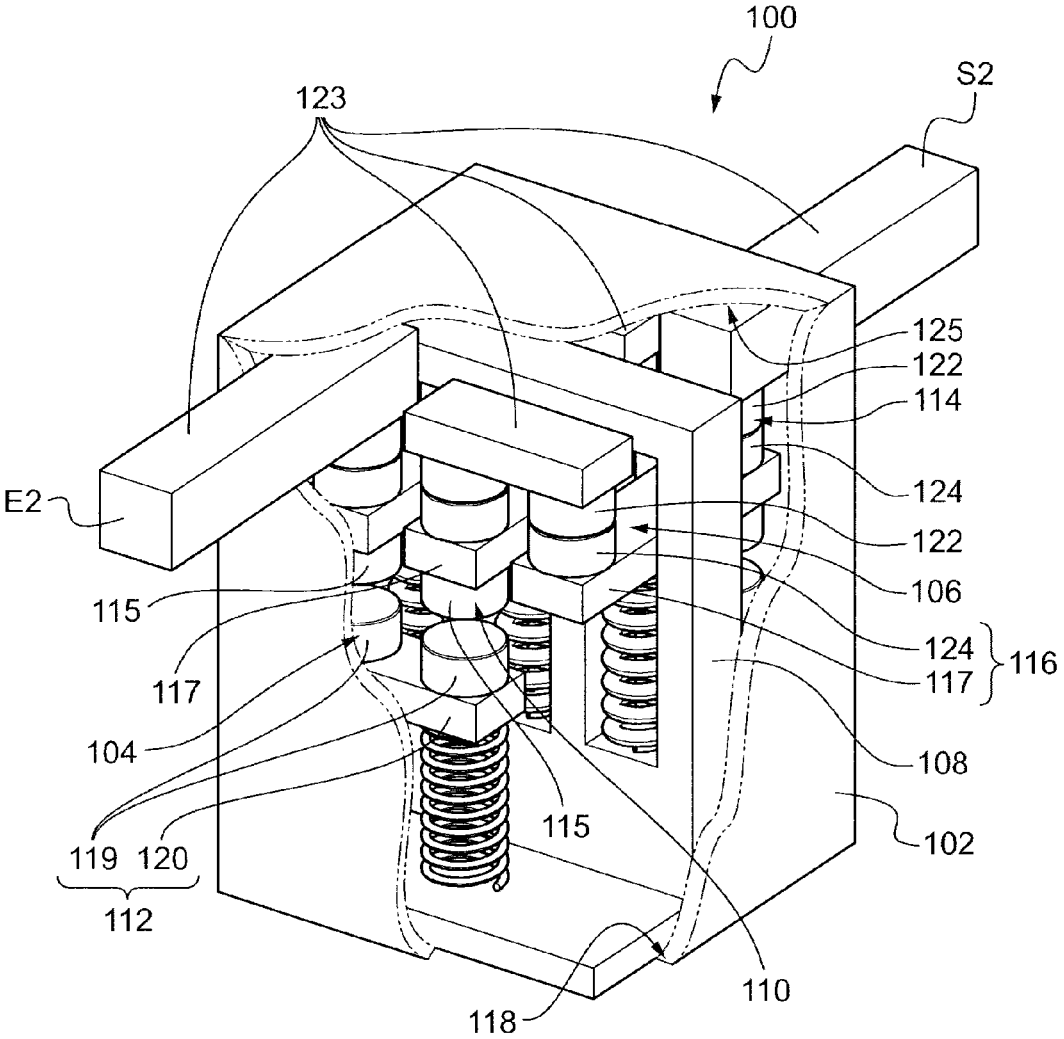
FIG. 2 is a perspective illustration of an electrical contactor according to one embodiment of the invention.

In FIG. 2, a contactor 100 corresponding to one embodiment of the invention is shown. The contactor 100 comprises a housing 102 that includes all of the elements comprised in the contactor 100.

The contactor 100 comprises two first switches 104 and three second switches 106. The contactor 100 also comprises a contact-holder 108 and two shafts, not shown, along which the contact-holder 108 is capable to translate.

The contactor 100 comprises a current input terminal E2 and a current output terminal S2.

Each first switch 104 comprises a first pair of fixed contacts 110 and a first moving contact 112 moving between a closed position and an open position. Likewise, each second switch 106 comprises a pair of second fixed contacts 114 and a second moving contact 116 moving between a closed position and an open position.

The contact-holder 108 is capable of maintaining the first moving contacts 112 and the second moving contacts 116. Furthermore, the contact-holder 108 is translatable along the shafts, in order to move the first moving contacts 112 and the second moving contacts 116 into the open or closed position.

The first fixed contacts 110 are for example each in the form of a pellet 115, each pellet 115 being secured to a first corresponding moving bridge 117, and oriented toward a lower inner surface 118 of the housing 102.

Each first moving contact 112 comprises two first contact pellets 119 secured to a second moving bridge 120 and connected by said second moving bridge 120. Each first moving contact 112 is connected to the contact-holders 108 by a first spring 121.

The second fixed contacts 114 are for example each in the form of a pellet 122, each pellet 122 being secured to a corresponding fixed bridge 123.

Each second moving contact 116 comprises two second contact pellets 124 secured to the first moving bridge 117 and connected by that first moving bridge 117. Said second pellets 124 are oriented toward an upper inner surface 125 of the housing 102. Each second moving contact 116 is connected to the contact-holders 108 by means of a second spring 126.

The first, second fixed contacts 110 and 114, respectively, are in the closed position of the first 112, second 116 moving contact, respectively, connected to each other via the first 112, second 116 moving contact, respectively, and are electrically isolated from each other, in the opening position of the first 112, second 116 moving contact, respectively.

In the open position of the first 112 and second 116 moving contacts, the contact-holder 108 is in the low position, for example abutting against the lower inner surface 118.

In the closed position of the first 112 and second 116 moving contacts, the contact-holder 108 is in the high position, for example abutting against the upper inner surface 125.

In this embodiment, according to the invention, all of the contacts 110, 112, 114, 116 are sized so that their heating at the rated working current of the electrical facility, is below the normative values. As an example, for a rated working current of 65 Amperes, the heating of all of the contacts 110, 112, 114 and 116 is below 65° Celsius.

The second moving contacts 116 and the second fixed contacts 114 are sized so as to have a minimal deterioration when an electric arc appears, during opening of each second moving contact 116. In fact, the second switches 106 are intended, when their second moving contact 116 is opened, to have an electric arc form between the second moving contacts 116 and the second fixed contacts 114.

A control device, not shown in the different figures, is capable of controlling the movement of the contact-holder 108 to open or close the first 104 and second 106 switches, i.e., to control the movement of each first moving contact 112 and each second moving contact 116.

Each first spring 121 is capable of exerting a first thrust force P1 on each first moving contact 112.

Each second spring 126 is capable of exerting a second thrust force P2 on each second moving contact 116, which is greater than the first thrust force P1.

The contactor 100 has a globally stepped structure with the first switches 104 situated below the second switches 106 relative to the upper surface 125.

Figure 3:
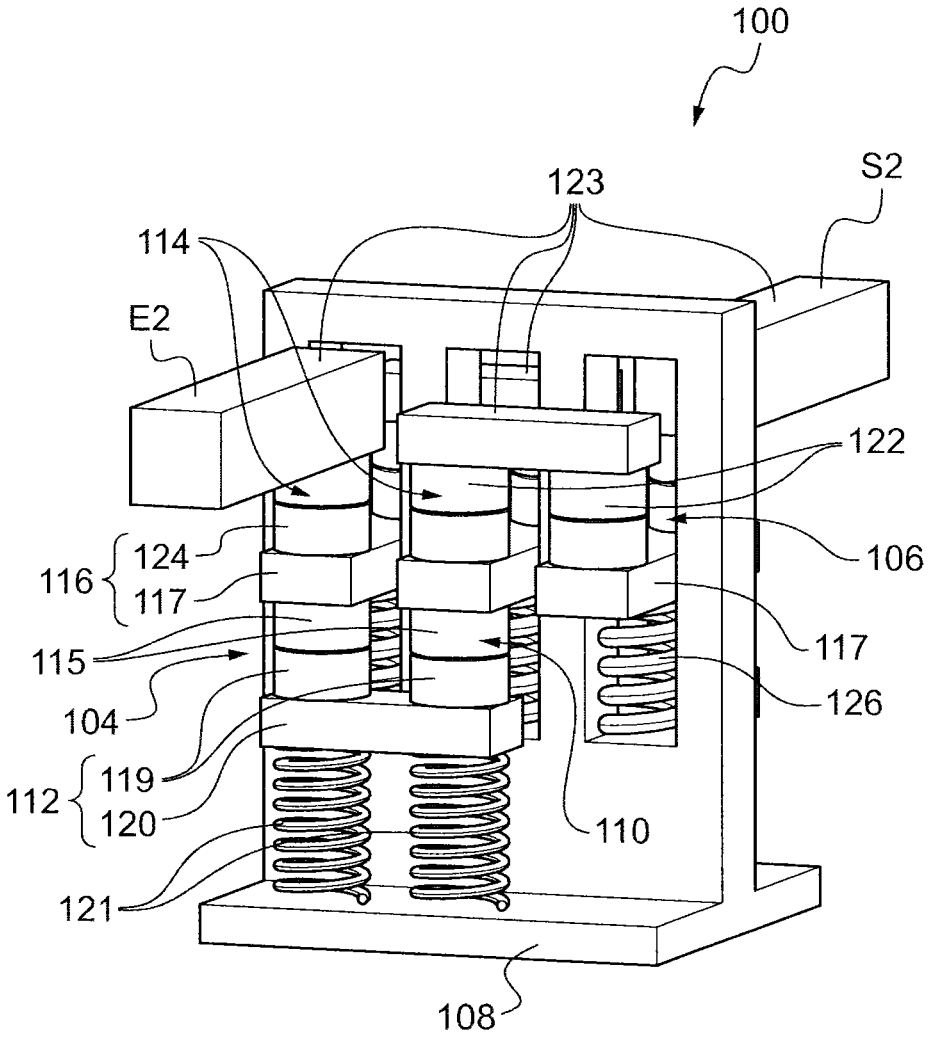
FIG. 3 is an illustration of a contact-holder for the contactor of FIG. 2, in the high position, the contacts borne by the contact-holder being in the closed position.

In FIG. 3, the first switches 104 and the second switches 106 are in the closed position. The second moving contacts 116 are connected in parallel via the first switches 104, the fixed bridges 123 and the second fixed contacts 114. In fact, the connection of the fixed bridges 123 that connects the fixed contacts 114 belonging to different second switches 106, and the connection of the first switches 104 to the second switches 106, via the first fixed contacts 110, makes it possible to connect the second switches 106, and more particularly the second moving contacts 116 and their first moving bridges 117, in parallel. The input terminal E2 and the output terminal S2 are then connected to each other.

After the control device (not shown) receives an order to open the contactor 100, when the contactor 100 is in the configuration of FIG. 3, the control device controls the movement of the contact-holder 108 toward the lower inner surface 118.

Figure 4:
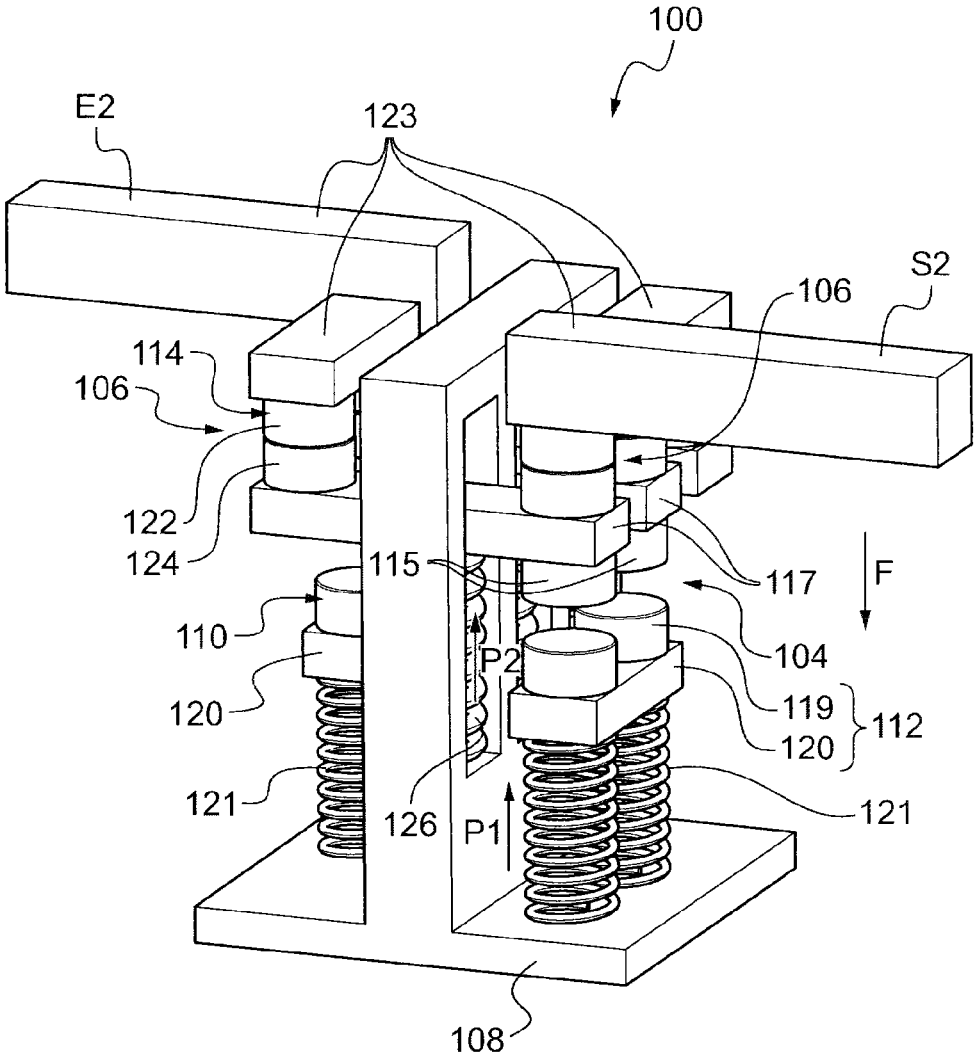
FIG. 4 is an illustration of the contact-holder of FIG. 3, in an intermediate position where some contacts are in the open position and others are in the closed position.

When the contact-holder 108 is moved toward the lower surface 118, as shown by arrow F in FIG. 4, this causes the first moving contacts 112 to move toward the lower surface 118. Once the thrust force P1, exerted by the first springs 121 and making it possible to keep the first moving contacts 112 in the closed position, is canceled out, the first moving contacts 112 are in the open position. This configuration is shown in FIG. 4.

It should be noted that in the configuration of FIG. 4, when the second moving contacts 116 are in the closed position, while the first moving contacts 112 are in the open position, the input terminal E2 and the output terminal S2 are electrically connected by the second switches 106, which are then connected in series. Thus, the opening of the first switches 104 makes it possible to go from an operating mode where the second switches 106 are connected in parallel to an operating mode where the second switches 106 are connected in series.

Figure 5:
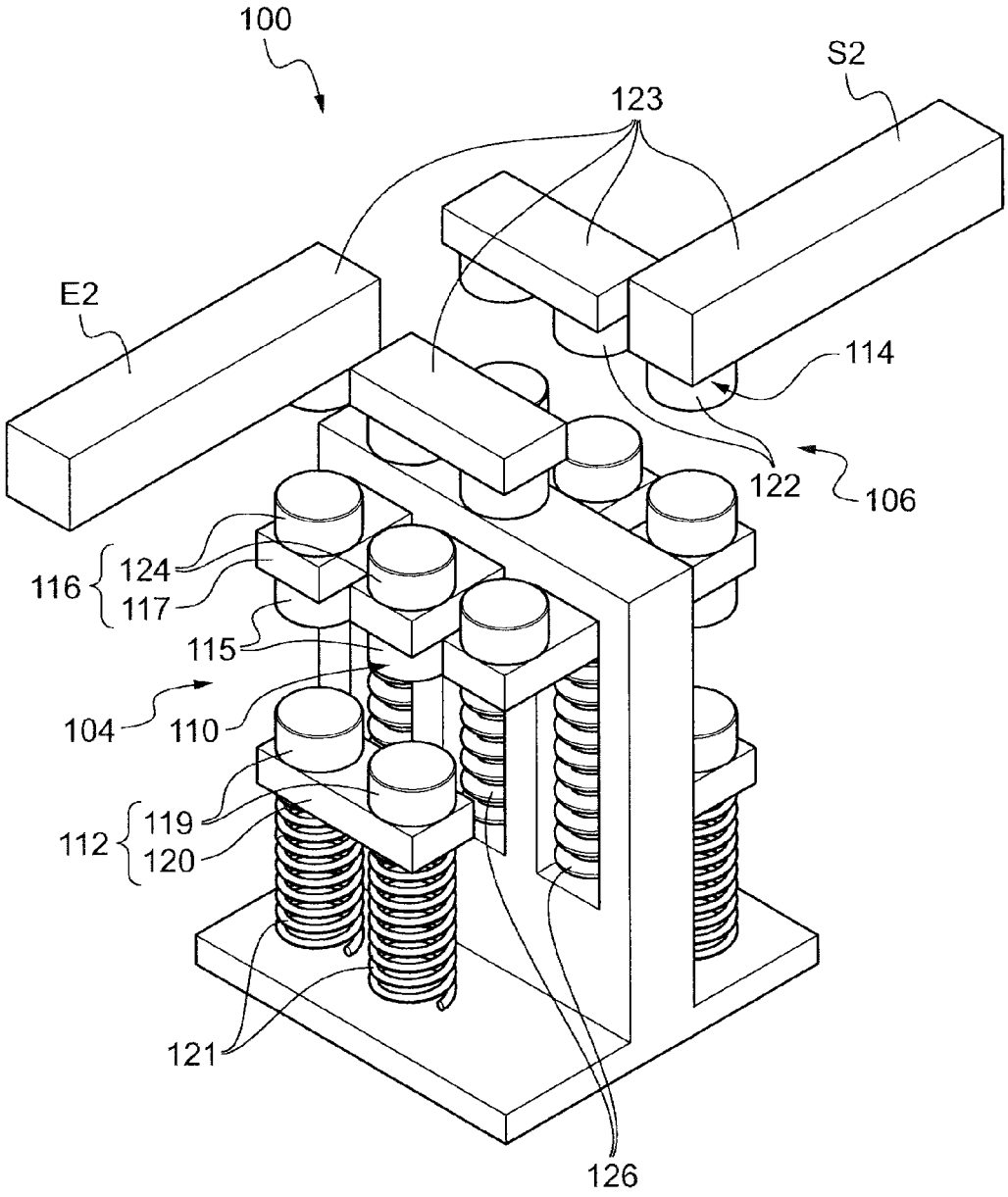
FIG. 5 is an illustration of the contact-holder of FIGS. 3 and 4, in the low position, for which all of the contacts are in the open position.
Figure 6:
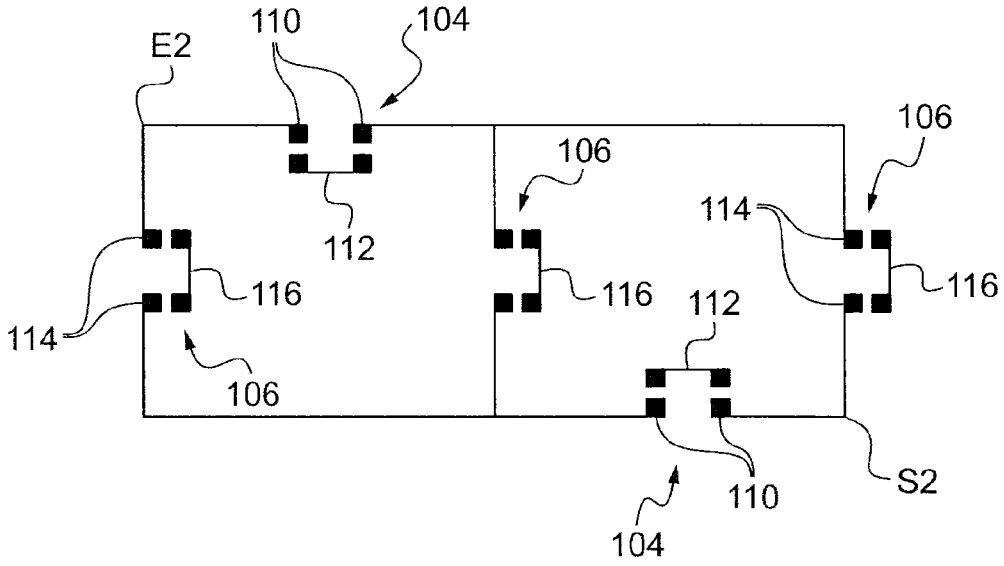
FIG. 6 is an equivalent electrical diagram of the contactor of FIG. 2.

The equivalent electrical diagram of the contactor 100 shown in FIG. 6 illustrates the feature according to which, depending on the open or closed position of the first moving contacts 112, the second switches 106 are connected in parallel or in series. In the example embodiment of FIGS. 2 to 6, when the first moving contacts 112 are in the closed position, the second switches 106 are connected in parallel, and when the first moving contacts 112 are in the open position, the second switches 106 are connected in series.

Then, the contact-holder 108 continues its movement, which causes the second moving contacts 116 to move, the latter nevertheless remaining in the closed position, since the thrust force P2 exerted by the second spring 126 is sufficient to keep them in the closed position.

After the contact-holder 108 has been translated by a predetermined distance, the second thrust force P2 is canceled out, since it is offset by the movement of the contact-holder 108, which, when it moves, exerts a force so as to move the second moving contacts 116 in a direction opposite that of the second thrust force P2. The second thrust force P2 becomes insufficient to keep the moving contacts 116 in the closed position, which then separate from the second fixed contacts 114. In fact, once the second thrust force P2 has been compensated by the movement of the contact-holder 108, each moving contact 116 moves toward the lower surface 118 and is separated from the fixed contacts 114.

In FIG. 5, each first switch 104 and each second switch 106 are in the open position.

Owing to this structure of the contact-holder 108 and the contactor 100, when an electric fault appears, each first moving contact 112 is moved into the open position with a time offset relative to the movement of each second moving contact 116. More specifically, each first moving contact 112 is moved into the open position before each second moving contact 116 is moved into the open position. The time offset between the movement of the first moving contacts 112 into the open position and the movement of the second moving contacts 116 into the open position is comprised between 10 ms and 1 s, preferably comprised between 50 ms and 500 ms, still more preferably comprised between 50 ms and 100 ms.

The fact that the second switches 106 are connected in series, in the configuration of FIG. 4, makes it possible to split the electric arc once they are moved into the open position as shown in FIG. 5. Thus, the moving 116 and fixed 114 contacts are separated optimally without any risk of being welded to each other.

A method for controlling the contactors according to the embodiment of the invention thus comprises several steps. A first step consists of the control device 20 receiving the order to open the contactor 10, 100 when the first 12, 104 and second 14, 116 switches are in the closed position. Then, a second step consists of moving each first moving contact 26, 112 into the open position. Lastly, a third step consists of moving each second moving contact 30, 116 into the open position, once each first moving contact 26, 112 is in the open position and with a time offset comprised between 10 ms and 1 s, preferably comprised between 50 ms and 500 ms, and still more preferably comprised between 50 ms and 100 ms.

Furthermore, in the embodiment of the invention, the second switches 106 are connected in parallel before the second step of the control method, since each first moving contact 112 is in the closed position, and the second switches 106 are connected in series after the second step and before the third step of the control method, since each first moving contact 112 is in the open position.

The embodiment of the invention makes it possible to produce contactors 10 with compact dimensions, i.e., with a length of 100 millimeters, a width of 50 mm and a height of 50 mm, for instance. In fact, the number of second switches 14, 106 connected in series and dedicated to cutoff, i.e., capable of having an electric arc form between their second moving contacts 30, 116 and their second fixed contacts 28, 114, is for example increased so as to be suitable for the cutoff of high voltages. The increased number of contacts in series makes it possible to split the electric arc.

The aspect not included in the invention makes it possible to propose a still further reduced bulk of the contactor 10, due to the fact that the second switches 14 have smaller dimensions than the first switches 12, since their contacts 28, 30 are not sized to have a limited heating, unlike the contacts 24, 26 of the first switches 12. In fact, the second switches 14 are connected in parallel with a first switch 12 dedicated to the thermal function, i.e., capable of undergoing heating below a normative value, when it is passed through by a rated current.

Furthermore, the embodiment of the invention allows a certain configurability, since the number and size of the fixed contacts 24, 28, 110, 114 and moving contacts 26, 30, 112, 116 is variable.

According to the aforementioned aspect, the second switches 14 are sized based on the requirements of the electrical facility, independently of the first switch 12.

As an alternative to the aforementioned aspect, the control device comprises a single control member capable of moving the first contact-holders and the contactor comprises a mechanical member capable of following the same movement as that of the first contact-holder and moving the second contact-holder. When the first and second switches are in the closed position, the mechanical member is at a certain distance from the second contact-holder, such that the movement of the second contact-holder is done with a time offset relative to the movement of the first contact-holder. This time offset depends on the distance between the mechanical member and the second contact-holder when the first and second moving contact(s) are in the closed position.

Furthermore, in the embodiment of the invention, the fact that the second switches 106 are connected in parallel when the first moving contact 112 is in the closed position makes it possible to distribute a current passing through the contactor 100 between the different switches 106, and thus to limit the current passing through each second switch 106. This makes it possible to limit the heating experienced by the second switches 106 when a current passes through the contactor 100, and thus to propose second switches 106 with reduced dimensions. The bulk of the contactor 100 is therefore limited.

The invention claimed is:

1. An electrical contactor comprising:

one or more first switches, each of the one or more first switches including a pair of first fixed contacts and a first moving contact moving between a closed position and an open position, several second switches, each second switch including a pair of second fixed contacts and a second moving contact moving between a closed position and an open position, the first and second fixed contacts, respectively, being, in the closed position of the first moving contact and the second moving contact, respectively, electrically connected to each other via the first moving contact and the second moving contact, respectively, and being electrically isolated from each other in the open position of the first moving contact and the second moving contact, respectively, at least one control device configured to control the movement of each first moving contact and second moving contact, respectively, in the open or closed position, wherein the electrical contractor further comprises, in a same housing, the one or more first switches and the second switches, wherein after the control device receives an order to open the electrical contactor, the control device is capable of controlling the movement of at least one first moving contact into the open position before that of each second moving contact into the open position with a time offset comprised between 10 milliseconds (ms) and 1 second between the movement of the at least one first moving contact and the movement of a respective second moving contact and wherein when the first moving contact is in the closed position, the second switches are connected in parallel, whereas when the first moving contact is in the open position, the second switches are connected in series.

2. The contactor according to claim 1, wherein the contactor comprises a single contact-holder maintaining the at least one first moving contact and the second moving contacts, the control device being capable of controlling the movement of said contact-holder to open or close the one or more first switches and the second switches.

3. The contactor according to claim 2, wherein the contact-holder is connected to the at least one first moving contact and each second moving contact by at least one first spring and at least one second spring, respectively, and wherein a first thrust force exerted by the at least one first spring on the at least one first moving contact is below a second thrust force exerted by the at least one second spring on each second moving contact.

4. A method for controlling an electrical contactor, comprising one or more first switches, each of the one or more first switches including a pair of first fixed contacts and a first moving contact moving between a closed position and an open position, several second switches, each second switch including a pair of second fixed contacts and a second moving contact moving between a closed position and an open position, the first and second fixed contacts, respectively, being, in the closed position of the first moving contact and the second moving contact, respectively, electrically connected to each other via the first moving contact and the second moving contact, respectively, and being electrically isolated from each other in the open position of the first moving contact and the second moving contact, respectively, at least one control device configured to control the movement of each first moving contact and second moving contact, respectively, in the open or closed position, the method comprising:

receiving by the control device an order to open the contactor;

controlling, by the control device, movement of at least one first moving contact into the open position, the second switches being connected in parallel when the at least one first moving contact is in the closed position, and in series when the at least one first moving contact is in the open position, controlling, by the control device, movement of each second moving contact into the open position after that of the at least one first moving contact into the open position with a time shift comprised between 10 milliseconds (ms) and 1 second between the movement of the at least one first moving contact and the movement of a respective second moving contact.

5. The contactor according to claim 1, wherein the time offset is comprised between 50 ms and 500 ms between the movement of the at least one first moving contact and the movement of the respective second moving contact.

6. The contactor according to claim 1, wherein the time offset is comprised between 50 ms and 100 ms between the movement of the at least one first moving contact and the movement of the respective second moving contact.

7. The method for controlling the electrical contactor according to claim 4, wherein the time shift is comprised between 50 ms and 500 ms between the movement of the at least one first moving contact and the movement of the respective second moving contact.

8. The method for controlling the electrical contactor according to claim 4, wherein the time shift is comprised between 50 ms and 100 ms between the movement of the at least one first moving contact and the movement of the respective second moving contact.

* * * * *